US007641455B2

(12) United States Patent
Fujiwara et al.

(10) Patent No.: US 7,641,455 B2
(45) Date of Patent: Jan. 5, 2010

(54) SCROLL COMPRESSOR WITH REDUCED OLDHAM RING NOISE

(75) Inventors: Yukihiro Fujiwara, Shiga (JP); Osamu Aiba, Shiga (JP)

(73) Assignee: Panasonic Corporation, Osaka (JP)

( * ) Notice: Subject to any disclaimer, the term of this patent is extended or adjusted under 35 U.S.C. 154(b) by 15 days.

(21) Appl. No.: 11/995,381

(22) PCT Filed: Jul. 6, 2006

(86) PCT No.: PCT/JP2006/313509

§ 371 (c)(1),
(2), (4) Date: Mar. 4, 2008

(87) PCT Pub. No.: WO2007/007645

PCT Pub. Date: Jan. 18, 2007

(65) Prior Publication Data

US 2009/0148326 A1 Jun. 11, 2009

(30) Foreign Application Priority Data

Jul. 13, 2005 (JP) ..... 2005-204167

(51) Int. Cl.
*F03C 2/00* (2006.01)
*F03C 4/00* (2006.01)
*F04C 18/00* (2006.01)

(52) U.S. Cl. ..... 418/55.3; 418/150; 418/179

(58) Field of Classification Search ..... 418/55.1–55.6, 418/57, 150, 179; 464/102–105
See application file for complete search history.

(56) References Cited

U.S. PATENT DOCUMENTS

| | | | | | |
|---|---|---|---|---|---|
| 5,275,543 | A | * | 1/1994 | Tanaka et al. | 418/55.3 |
| 5,382,144 | A | * | 1/1995 | Tanaka et al. | 418/55.3 |
| 5,931,651 | A | * | 8/1999 | Kawano et al. | 418/55.3 |
| 6,210,136 | B1 | * | 4/2001 | Kawano et al. | 418/55.3 |
| 6,358,028 | B1 | * | 3/2002 | Abe et al. | 418/55.3 |

FOREIGN PATENT DOCUMENTS

| | | | | | |
|---|---|---|---|---|---|
| JP | 63192979 | A | * | 8/1988 | 418/55.3 |
| JP | 02283882 | A | * | 11/1990 | 418/55.3 |
| JP | 05079474 | A | * | 3/1993 | 418/55.3 |
| JP | 06088579 | A | * | 3/1994 | 418/55.3 |

* cited by examiner

*Primary Examiner*—Theresa Trieu
(74) *Attorney, Agent, or Firm*—RatnerPrestia

(57) ABSTRACT

Impulsive sound of an Oldham ring is reduced and a driving noise of a scroll compressor is prevented from increasing. When a width of the key of the Oldham ring made of iron-based material is defined as t and a width of the orbiting-side key groove in the back surface of the surface plate of the orbiting scroll made of aluminum-based material and a width of the fixed-side key groove of the main bearing member made of aluminum-based material on the side of a thrust surface are defines as s, a gap d generated at s−t with respect to a key pitch L of the Oldham ring I set in a range of $(6\times10^{-5})\leqq d/L\leqq(3.5\times10^{-4})$. With this, even if the key of the Oldham ring vibrates in the key groove, a collision force against the key groove is weakened, impulsive sound of the Oldham ring becomes small, and a driving noise of the scroll compressor is can be reduced.

2 Claims, 4 Drawing Sheets

[Fig. 1]
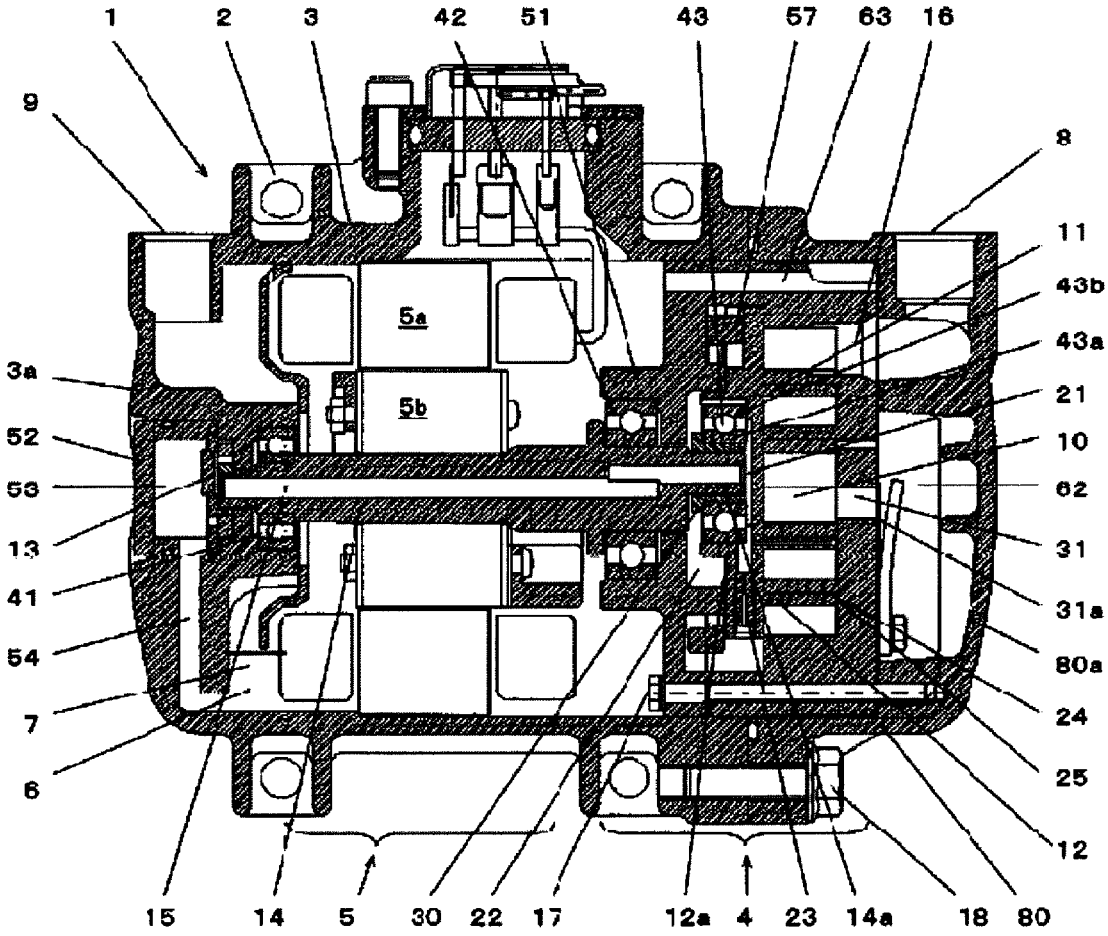

[Fig. 2]
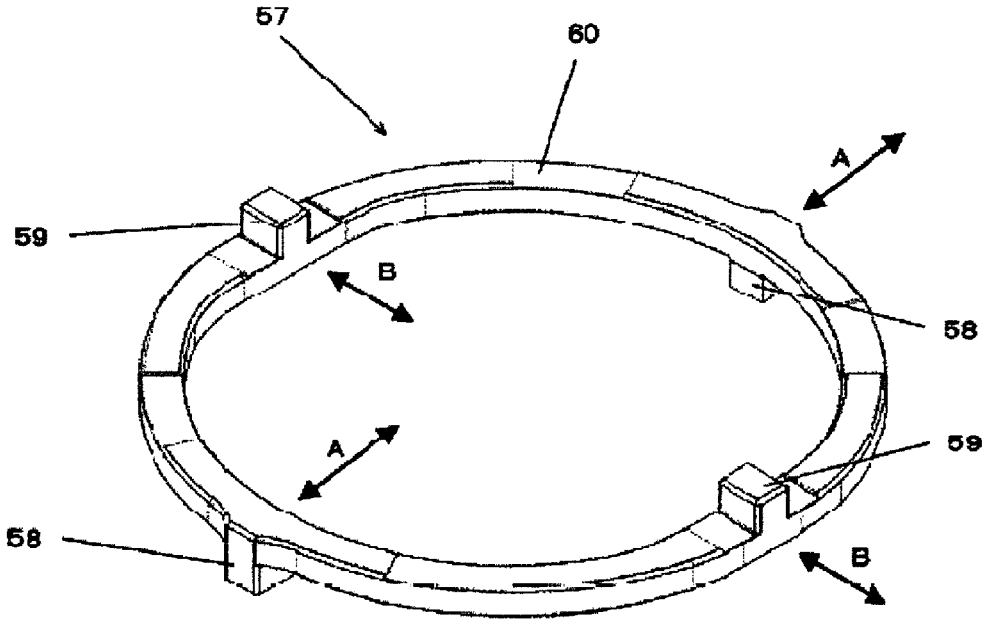
[Fig. 3]
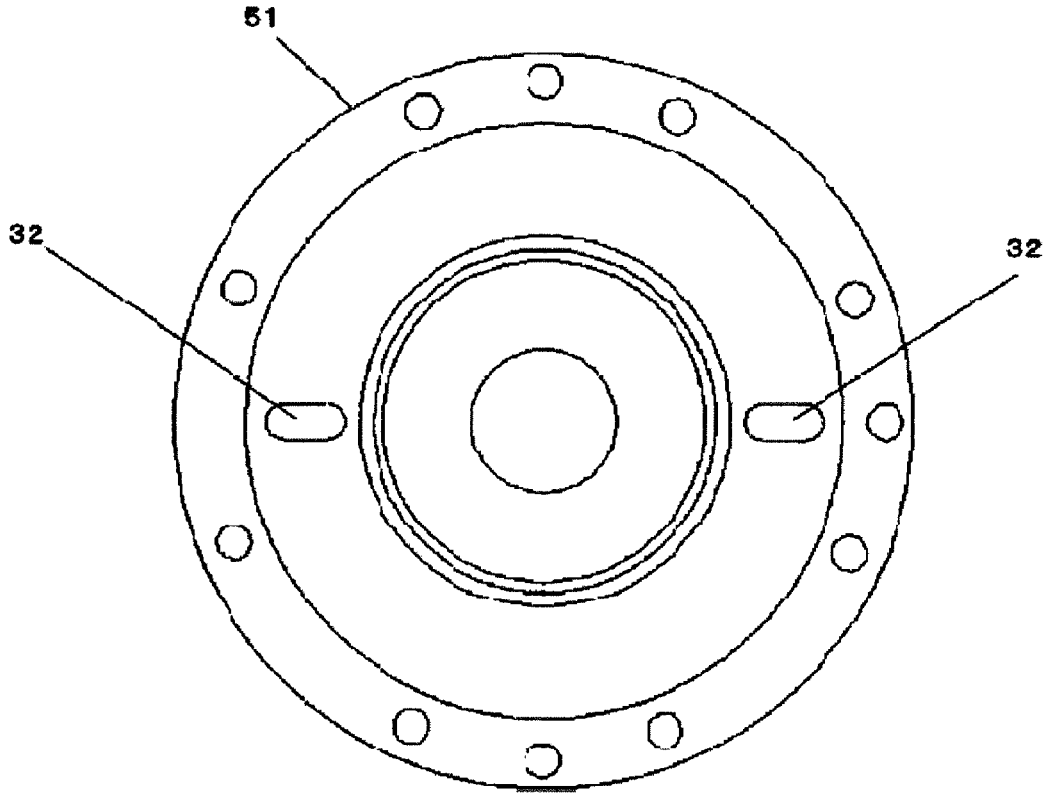

[Fig. 4]
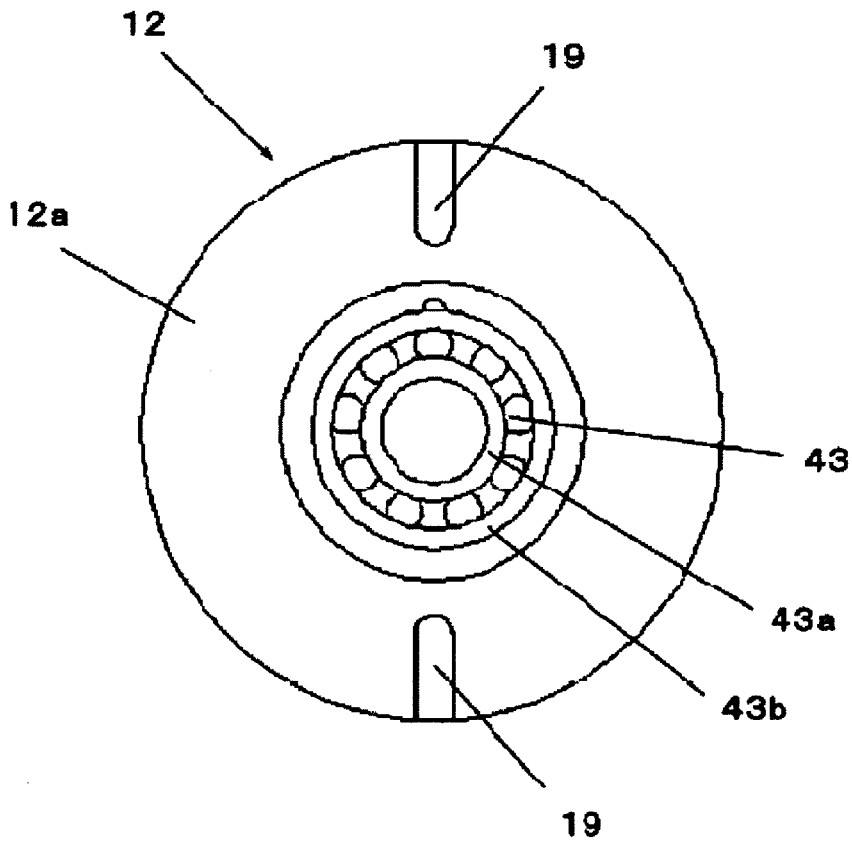
[Fig. 5]
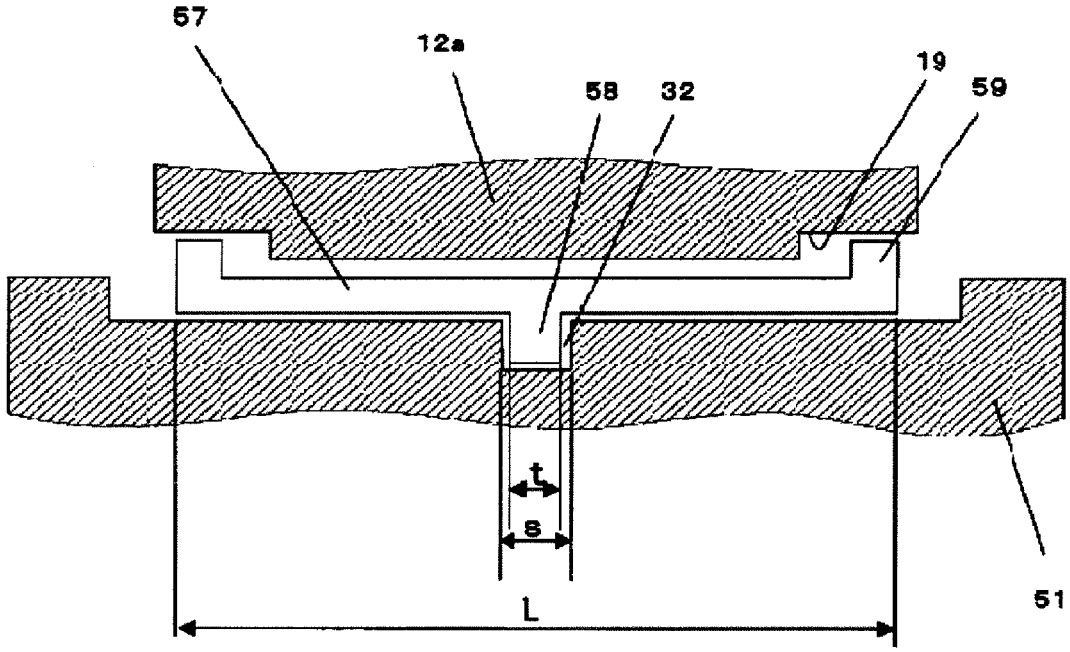

[Fig. 6] PRIOR ART
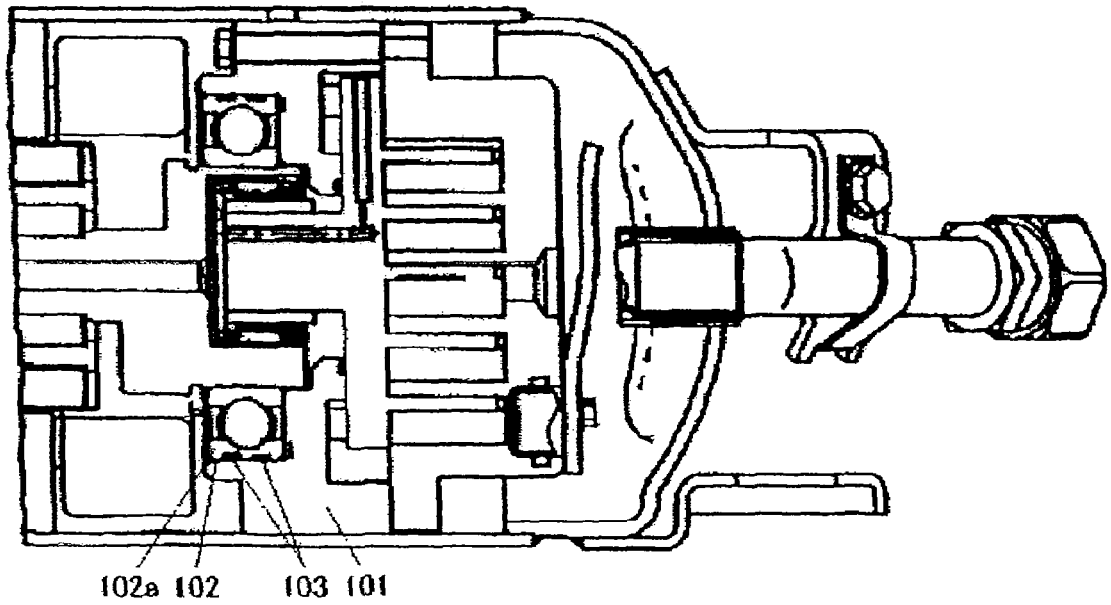

SCROLL COMPRESSOR WITH REDUCED OLDHAM RING NOISE

TECHNICAL FIELD

The present invention relates to noise reduction of a scroll compressor applied to an air conditioner and a freezer.

BACKGROUND TECHNIQUE

Conventionally, a scroll compressor of this kind is utilized as a compressor for a home air conditioner and a home refrigerator, and is also used as a compressor for an automobile air conditioner recently.

In recent years, a hybrid automobile in which both an engine and a motor are used as the situation demands becomes commercially practical, and becomes widespread abruptly. Since the original purpose of the hybrid automobile is to reduce an influence of an engine on environment, when the hybrid automobile stops for a short time due to a traffic signal, a case in which the engine is stopped and only a compressor is operated can frequently occur. In such a case, there is a problem that fine vibration or operation sound of the compressor which was buried in the engine sound is transmitted to a driver and a passenger as noise through a frame of the vehicle body.

As one of methods for reducing noise of the compressor, there is disclose a technique in which an elastic member is interposed between a bearing and a support member to absorb vibration and noise, thereby reducing noise (e.g., patent document 1).

FIG. 6 is a sectional view of a conventional electric compressor. That is, when a main ball bearing 102 is to be fitted to a main support member 101, resin rings 103 are press fitted around an outer periphery of an outer lace 102*a* of the main ball bearing 102. With this, elastic forces of the resin rings 103 act between the outer lace 102*a* and the main support member 101, vibration and noise are absorbed, and driving stability and silence can be enhanced.

An Oldham ring, an orbiting scroll and a main bearing member of the conventional scroll compressor are made of iron-based material. If an attempt is made to reduce the weight of the scroll compressor taking into consideration a case that the scroll compressor is provided in a vehicle such as a hybrid automobile, it is necessary to reduce the weight of each part. For this purpose, it is conceived to make the orbiting scroll, the main bearing member, a container and the like of aluminum-based material.

[Patent Document 1] Japanese Patent Application Laid-open No. H11-44296

DISCLOSURE OF THE INVENTION

Problem to be Solved by the Invention

The parts such as the orbiting scroll and the main bearing member can be made of aluminum-based material to reduce the weight, but the material of the Oldham ring is still iron-based material in terms of strength thereof. Therefore, when the temperature of the scroll compressor becomes high at the time of driving, there is a tendency that a gap between sliding parts becomes large due to a difference in expansion coefficients caused by different materials, and it is necessary to strictly manage the sizes of the parts.

That is, a rotation force generated in the orbiting scroll is largely varied during one rotation by a compressed gas force generated by compressing motion of the compressor and a centrifugal force of the orbiting scroll. Therefore, pushing forces of a fixed-side key and an orbiting-side key against a fixed-side key groove and an orbiting-side key groove are varied. Such variation destabilize behavior of the orbiting scroll if a gap between sliding parts is great, and it is necessary to strictly manage the sizes.

Due to the variation, the keys are vibrated in the key grooves and impulsive sound is generated, and there is a problem that driving noise of the scroll compressor is increased.

Therefore, it is an object of the present invention to provide a scroll compressor which employs an aluminum-based material, reduces impulsive sound of the Oldham ring, and prevents the driving noise of the compressor from increasing, thereby reducing the weight and noise of the compressor.

Means for Solving Problem

According to a first aspect of the present invention, there is provided a scroll compressor comprising: a motor accommodated in a container; and a compression mechanism which includes an orbiting scroll which has a scroll lap formed on a surface plate uprightly and which is driven by the motor, a fixed scroll which has a scroll lap formed on a surface plate uprightly and which is combined with the orbiting scroll, a main bearing member, and an Oldham ring which is provided between the orbiting scroll and the main bearing member and which orbits the orbiting scroll while preventing the orbiting scroll from rotating, in which the orbiting scroll and the main bearing member are made of aluminum-based material, the Oldham ring is made of iron-based material, mutually intersecting projecting keys are formed on both surfaces of the Oldham ring, and key grooves into which the keys are fitted for sliding motion are formed such that a back surface of a surface plate of the orbiting scroll and the main bearing member on the side of a thrust surface are mutually intersecting, wherein when a width of the key of the Oldham ring is defined as t and a width of the key groove in the back surface of the surface plate of the orbiting scroll and a width of the key groove of the main bearing member on the side of the thrust surface are defined as s, a gap d generated at s−t is set in a range of $(6\times10^{-5})\leqq d/L\leqq(3.5\times10^{-4})$ with respect to a key pitch L of the Oldham ring.

According to a second aspect, in the first aspect, at least one of a sliding part of the Oldham ring, a sliding part of the orbiting scroll with respect to the Oldham ring, and a sliding part of the main bearing member with respect to the Oldham ring is subjected to wear resistance surface processing.

EFFECT OF THE INVENTION

According to the scroll compressor of the invention, even if the orbiting scroll and the main bearing member are made of aluminum-based material, it is possible to prevent driving noise from increasing without deteriorating the reliability. Therefore, it is possible to reduce weight and noise of the compressor.

BRIEF DESCRIPTION OF THE DRAWINGS

FIG. 1 is a sectional view of a scroll compressor according to an embodiment of the present invention;

FIG. 2 is a perspective view of an Oldham ring of the scroll compressor shown in FIG. 1;

FIG. 3 is a front view of a main bearing member of the scroll compressor shown in FIG. 1;

FIG. 4 is a front view of a back surface of an orbiting scroll surface plate of the scroll compressor shown in FIG. 1;

FIG. 5 is a sectional view of an essential portion of an Oldham ring sliding part of the scroll compressor shown in FIG. 1; and FIG. 6 is a sectional view of a conventional electric compressor.

EXPLANATION OF SYMBOLS

1 scroll compressor
3 main body casing
4 compression mechanism
5 motor
11 fixed scroll
12 orbiting scroll
12*a* orbiting scroll surface plate
19 orbiting-side key groove
32 fixed-side key groove
51 main bearing member
57 Oldham ring
58 fixed-side key
59 orbiting-side key
60 ring portion
80 sub-casing

BEST MODE FOR CARRYING OUT THE INVENTION

In the scroll compressor of the first aspect of the invention, when a width of the key of the Oldham ring is defined as t and a width of the key groove in the back surface of the surface plate of the orbiting scroll and a width of the key groove of the main bearing member on the side of the thrust surface are defined as s, a gap d generated at s−t is set in a range of $(6\times10^{-5})\leqq d/L\leqq(3.5\times10^{-4})$ with respect to a key pitch L of the Oldham ring. According to this aspect, when the compressor is operated, even if the key of the Oldham ring vibrates in the key groove, a collision force against the key groove is weakened, impulsive sound of the Oldham ring becomes small, and it is possible to prevent a driving noise of the scroll compressor from increasing.

According to the second aspect, in the first aspect, at least one of a sliding part of the Oldham ring, a sliding part of the orbiting scroll with respect to the Oldham ring, and a sliding part of the main bearing member with respect to the Oldham ring is subjected to wear resistance surface processing. With this aspect, the sliding part is smoothened, and it is possible to prevent the driving noise from increasing, and to further enhance the reliability.

Embodiment

An embodiment of the present invention will be explained with reference to FIGS. 1 to 5. The invention is not limited to the embodiment. FIG. 1 is a sectional view of a scroll compressor of the embodiment of the invention.

In FIG. 1, the scroll compressor 1 of the embodiment is a horizontal type scroll compressor which is disposed horizontally by mounting legs 2 provided around a body of the scroll compressor 1.

That is, in the scroll compressor 1, a compression mechanism 4 and a motor 5 which drives the compression mechanism 4 are accommodated in a container comprising a main casing 3 and a sub-casing 80 which are made of aluminum alloy. The scroll compressor 1 includes a liquid reservoir 6 in which lubricant for lubricating sliding parts including the compression mechanism 4 is stored. The motor 5 is driven by a motor driving circuit (not shown).

Here, working fluid to be handles is refrigerant. A lubricant 7 used for lubricating the sliding parts and for sealing the sliding part of the compression mechanism 4 is compatible with the refrigerant.

Basically, it is only required that in the scroll compressor, the compression mechanism 4 which sucks, compresses and discharges liquid, the motor 5 which drives the compression mechanism 4, and the liquid reservoir 6 in which the lubricant 7 used for lubricating the sliding parts including the compression mechanism 4 is stored are accommodated in the main casing 3 or the like, and the motor 5 is driven by the motor driving circuit. The following description does not limit the scope of the patent claims.

A pump 13, an auxiliary bearing 41, the motor 5 and a main bearing member 51 having a main bearing 42 are disposed in the main casing 3 from one of end walls 3*a* in the axial direction. The main bearing member 51 is also made of aluminum alloy.

A pump 13 is accommodated in the main casing 3 from its outer surface of the end wall 3*a*, and is held between the end wall 3*a* and a lid 52 which is fitted thereafter. A pump chamber 53 is formed inside the lid 52, and the pump chamber 53 is in communication with the liquid reservoir 6 through a pumping passage 54. The auxiliary bearing 41 is supported by the end wall 3*a*, and rotatably supports a drive shaft 14 on the side of the pump 13. The motor 5 includes a stator 5*a* fixed to an inner periphery of the main casing 3 by shrinkage fitting, and a rotor 5*b* fixed to the drive shaft 14. The motor 5 rotates and drives the drive shaft 14.

The main bearing member 51 is fixed to an inner periphery of the sub-casing 80 by a bolt 17, and holds the main bearing 42. The main bearing 42 rotatably supports the drive shaft 14 on the side of the compression mechanism 4. A fixed scroll 11 is mounted on an outer periphery of the main bearing member 51 by a bolt (not shown), and an orbiting scroll 12 is sandwiched between the main bearing member 51 and the fixed scroll 11, thereby constituting the scroll compressor 1. An Oldham ring 57 is provided between (a thrust surface of) the main bearing member 51 and (an orbiting scroll of a surface plate 12*a* of) the orbiting scroll 12. The Oldham ring 57 prevents the orbiting scroll 12 from rotating and allows the orbiting scroll 12 to orbit.

An eccentric shaft 14*a* is integrally formed on an end of the drive shaft 14 on the side of the compression mechanism 4, and a bush 30 is fitted over the eccentric shaft 14*a*. The bush 30 enables the orbiting scroll 12 opposed to the fixed scroll 11 to orbit through the eccentric bearing 43. A cylindrical portion 12*b* projects from a back surface of the orbiting scroll surface plate 12*a* of the orbiting scroll 12, and the eccentric bearing 43 is accommodated in the cylindrical portion 12*b*. An inner lace 43*a* of the eccentric bearing 43 is fitted into the bush 30, and an outer lace 43*b* of the eccentric bearing 43 is fitted into the cylindrical portion 12*b*.

A portion of the compression mechanism 4 exposed from the sub-casing 80 is covered with the main casing 3 by butting openings of the sub-casing 80 and the main casing 3 with each other to fix them by means of a bolt 18. At that time, the end wall 3*a* is formed on the opposite side from the end wall 80*a* in the axial direction. The compression mechanism 4 is located between a suction port 8 provided in the sub-casing 80 and a discharge port 9 provided in the main casing 3.

A suction hole 16 formed in the fixed scroll 11 of the compression mechanism 4 is in communication with the suction port 8 of the sub-casing 80. A discharge port 31 of the fixed scroll 11 is in communication with a discharge chamber 62 on the side of the end wall 80*a* through a reed valve 31*a*. The discharge chamber 62 is in communication with the main casing 3 on the side of the motor 5 having the discharge port 9 between the compression mechanism 4 and the end wall 3*a* through a communication passage 63 formed between the fixed scroll 11 or the sub-casing 80 and between the main bearing member 51 and the main casing 3.

Next, the operation of the scroll compressor will be explained.

In the compression mechanism 4 of the scroll compressor 1 of the embodiment, when the orbiting scroll 12 is orbited with respect to the fixed scroll 11 through the drive shaft 14 by the motor 5, as shown in FIG. 1, a compression space 10 formed by meshing the aluminum alloy fixed scroll 11 and the aluminum alloy orbiting scroll 12 with each other moves while varying its capacity. With this capacity variation, a refrigerant returning from an outer cycle is sucked, compressed and discharged to the outer cycle through the suction port 8 of the sub-casing 80 and the discharge port 9 of the main casing 3.

That is, the motor 5 is driven by the motor driving circuit, and the motor 5 orbits the orbiting scroll 12 through a drive shaft 14 and drives the pump 13. In the compression mechanism 4, lubricant 7 in the liquid reservoir 6 is supplied by the pump 13 and the compression mechanism 4 receives lubricating and sealing effects, a refrigerant returning from the refrigeration cycle through the suction port 8 to the suction hole 16 is sucked into the compression space 10 and compressed, and the refrigerant is discharged from the discharge port 31 into the discharge chamber 62.

The refrigerant discharged into the discharge chamber 62 enters the main casing 3 on the side of the motor 5 through the communication passage 63, and the refrigerant is discharged from the discharge port 9 of the main casing 3 while cooling the motor 5. During this process, the lubricant 7 is separated by gas/liquid separation effect such as a collision and a throttle 23 of the refrigerant, and a partial lubricant 7 coexisting with the refrigerant lubricates the auxiliary bearing 41.

At the same time, the lubricant 7 stored in the liquid reservoir 6 of the main casing 3 is supplied to a liquid pool 21 formed in a back surface of the orbiting scroll 12 through an oil supply passage 15 of the drive shaft 14 by driving the positive-displacement pump 13 by the drive shaft 14. It is also possible to supply the lubricant 7 to the liquid pool 21 utilizing a pressure difference in the main casing 3.

A portion of the lubricant 7 supplied to the liquid pool 21 passes through the back surface of the orbiting scroll surface plate 12*a*, and the lubricant 7 is supplied to a side back surface of the outer periphery of the orbiting scroll 12 to backup the orbiting scroll 12 under a predetermined pressure limited by a throttle 23 or the like.

This lubricant 7 is supplied to a tip end of a scroll lap of the orbiting scroll 12 through the orbiting scroll 12. That is, the lubricant 7 is supplied to a holding groove 25 which holds the chip seal 24 to seal between the fixed scroll 11 and the orbiting scroll 12 and lubricate the fixed scroll 11 and the orbiting scroll 12.

Another portion of the lubricant 7 supplied to the liquid pool 21 passes through the eccentric bearing 43, the liquid pool 22 and the main bearing 42 to lubricate the main bearing 42 and the eccentric bearing 43 and then, flows out into the main casing 3 on the side of the motor 5, and is collected in the liquid reservoir 6.

The structure and the operation of the Oldham ring of the embodiment will be explained with reference to FIGS. 2 to 5.

FIG. 2 is a perspective view of the Oldham ring of the scroll compressor shown in FIG. 1. FIG. 3 is a front view of the main bearing member of the scroll compressor shown in FIG. 1. FIG. 4 is a front view of a back surface of the orbiting scroll surface plate of the scroll compressor shown in FIG. 1. FIG. 5 is a sectional view of an essential portion of an Oldham ring sliding part of the scroll compressor shown in FIG. 1.

The Oldham ring 57 is made of sintered alloy or chromium molybdenum steel. As shown in FIG. 2, the Oldham ring 57 includes a ring portion 60. The ring portion 60 is provided at its end surface with projecting fixed-side keys 58, and at its other end surface with orbiting-side keys 59. The fixed-side keys 58 and the orbiting-side keys 59 intersect with each other. The ring portion 60 is integrally formed with the fixed-side keys 58 and the orbiting-side keys 59.

As shown in FIG. 3, the fixed-side keys 58 are slidably fitted into fixed-side key grooves 32 extending in a radial direction of the main bearing member 51 on the side of its thrust surface. As shown in FIG. 4, the orbiting-side keys 59 are slidably fitted into orbiting-side key grooves 19 extending in a radial direction of a back surface of a surface plate 12*a* of the orbiting scroll 12.

If the drive shaft 14 rotates, the fixed-side keys 58 reciprocate in the fixed-side key grooves 32 in the direction A and the orbiting-side keys 59 reciprocate in the orbiting-side key grooves 19 in the direction B, by the rotation force of the orbiting scroll 12, in a state where the keys are pushed against the key grooves, and the orbiting motion in which rotation of the orbiting scroll 12 is prevented is carried out.

In this embodiment, both the orbiting scroll 12 and main bearing member 51 are made of aluminum-based material. In FIG. 5, a width of a key portion of the Oldham ring 57 (i.e., widths of the fixed-side key 58 and the orbiting-side key 59) is defined as t, a width of a key groove of a back surface of the surface plate 12*a* of the orbiting scroll 12 (i.e., a width of the orbiting-side key groove 19) and a width of a key groove of the main bearing member 51 on the side of the thrust surface (i.e., a width of the fixed-side key groove 32) are defined as s. In this state, a gap d generated at s−t is set in a range of $(6\times10^{-5})\leqq d/L\leqq(3.5\times10^{-4})$ with respect to a key pitch L of the Oldham ring 57. For example, if both the orbiting scroll 12 and main bearing member 51 are made of iron-based material, the gas d is set to about $(3.5\times10^{-4})<d/L\leqq(7\times10^{-4})$. In the case of iron-based material, strict size management is unnecessary as compared with aluminum-based material.

A reason of the above setting will be explained next. That is, the scroll compressor was operated while varying the gap d with respect to the key pitch L of the Oldham ring 57, and increase in impulsive sound was checked. As a result, if d/L of the Oldham ring 57 exceeded $(3.5\times10^{-4})$, it was confirmed that the possibility of generation of impulsive sound was increased. If d/L of the Oldham ring 57 was equal to or lower than $(3.0\times10^{-4})$, it was confirmed that no impulsive sound was generated and it was more preferable. This is because that if d/L is equal to or lower than $(3.5\times10^{-4})$, even if the Oldham ring 57 vibrates in the key groove, a collision force against the key groove is weakened, and the impulsive sound of the Oldham ring 57 becomes small.

The smaller the gap d, the smaller the noise caused by vibration becomes, bit but it is not appropriate to reduce the gap d to such a value that friction resistance is generated and noise caused by the friction resistance is generated. It was confirmed that d/L which is $(6\times10^{-5})$ or higher is preferable.

Therefore, in the scroll compressor of the embodiment, aluminum-based material is employed for the orbiting scroll and the main bearing member, and the gap d between the key of the Oldham ring 57 and the key groove with respect to the key pitch L is set in a range of $(6\times10^{-5})\leqq d/L\leqq(3.5\times10^{-4})$. With this configuration, the scroll compressor can be reduced in weight, and even if the key of the Oldham ring 57 vibrates in the key groove, the collision force against the key groove is weakened, the impulsive sound of the Oldham ring becomes small, and it is possible to prevent the driving noise of the scroll compressor from increasing.

In the scroll compressor of the embodiment, at least one of a sliding part of the Oldham ring 57, a sliding part of the orbiting scroll 12 with respect to the Oldham ring 57, and a sliding part of the main bearing member 51 with respect to the Oldham ring 57 is subjected to wear resistance surface processing such as anodic oxidation processing.

According to this structure, the sliding part is smoothened, and it is possible to prevent the driving noise from increasing, and to further enhance the reliability.

INDUSTRIAL APPLICABILITY

According to the scroll compressor of the present invention as described above, a gap between the key of the Oldham ring and the key groove of the back surface of the surface plate of the orbiting scroll, and a gap between the key of the Oldham ring and the key groove of the main bearing member on the side of the thrust surface are limited. With this, impulsive sound caused between the key and the key groove of the Oldham ring at the time of operation of the compressor can be reduced, and it is possible to prevent the driving noise from increasing. Therefore, the present invention can also be applied to a scroll type compressor in which no motor is accommodated.

The invention claimed is:

1. A scroll compressor comprising:

a motor accommodated in a container; and a compression mechanism which includes an orbiting scroll which has a scroll lap formed on a surface plate uprightly and which is driven by said motor, a fixed scroll which has a scroll lap formed on a surface plate uprightly and which is combined with said orbiting scroll, a main bearing member, and an Oldham ring which is provided between said orbiting scroll and said main bearing member and which orbits said orbiting scroll while preventing said orbiting scroll from rotating, in which said orbiting scroll and said main bearing member are made of aluminum-based material, said Oldham ring is made of iron-based material, mutually intersecting projecting keys are formed on both surfaces of said Oldham ring, and key grooves into which said keys are fitted for sliding motion are formed such that a back surface of a surface plate of said orbiting scroll and said main bearing member on the side of a thrust surface are mutually intersected, wherein when a width of said key of said Oldham ring is defined as t and a width of said key groove in said back surface of said surface plate of said orbiting scroll and a width of said key groove of said main bearing member on the side of the thrust surface are defined as s, a gap d generated at s−t is set in a range of $(6\times10^{-5})\leqq d/L\leqq(3.5\times10^{-4})$ with respect to a key pitch L of said Oldham ring.

2. The scroll compressor according to claim 1, wherein at least one of a sliding part of said Oldham ring, a sliding part of said orbiting scroll with respect to said Oldham ring, and a sliding part of said main bearing member with respect to said Oldham ring is subjected to wear resistance surface processing.

* * * * *